US009217285B2

(12) United States Patent
Connors

(10) Patent No.: US 9,217,285 B2
(45) Date of Patent: Dec. 22, 2015

(54) MATERIAL LIFTING MECHANISM

(76) Inventor: Edward F Connors, San Antonio, TX (US)

( * ) Notice: Subject to any disclaimer, the term of this patent is extended or adjusted under 35 U.S.C. 154(b) by 466 days.

(21) Appl. No.: 13/456,906

(22) Filed: Apr. 26, 2012

(65) Prior Publication Data

US 2013/0287531 A1 Oct. 31, 2013

(51) Int. Cl.

| | |
|---|---|
| ***E06C 7/12*** | (2006.01) |
| ***E06C 1/397*** | (2006.01) |
| ***B66B 9/193*** | (2006.01) |
| ***E06C 7/48*** | (2006.01) |

(52) U.S. Cl.

CPC ..... *E06C 1/397* (2013.01); *B66B 9/193* (2013.01); *E06C 7/12* (2013.01); *E06C 7/48* (2013.01)

(58) Field of Classification Search

CPC ..... B66B 9/193; B66B 9/187; B66B 9/16; E06C 1/397; E06C 7/12; E06C 7/48; E06C 7/16; B65G 65/23; B66F 7/22

USPC ..... 414/598, 639, 642, 640, 10, 11; 187/239, 240, 241; 182/103

See application file for complete search history.

(56) References Cited

U.S. PATENT DOCUMENTS

| | | | | | |
|---|---|---|---|---|---|
| 1,504,034 | A | * | 8/1924 | Erwin | 414/598 |
| 2,800,371 | A | * | 7/1957 | Quercetti | 182/103 |
| 3,099,103 | A | * | 7/1963 | Wright | 248/188.8 |
| 3,720,334 | A | * | 3/1973 | Permut et al. | 414/462 |
| 4,179,011 | A | | 12/1979 | Morawski | |
| 4,183,423 | A | * | 1/1980 | Lewis | 182/103 |
| 4,216,844 | A | * | 8/1980 | Klafs | 182/104 |
| 4,550,807 | A | * | 11/1985 | Ohlgren | 187/241 |
| 5,165,501 | A | | 11/1992 | Donahey | |
| 5,180,032 | A | | 1/1993 | Hidalgo | |
| 5,224,808 | A | * | 7/1993 | Macris | 414/11 |
| 5,322,403 | A | * | 6/1994 | Herde | 414/11 |
| 5,743,356 | A | | 4/1998 | Mitchell | |
| 5,855,252 | A | | 1/1999 | Vrolyks | |
| 5,911,287 | A | * | 6/1999 | Campbell | 182/103 |
| 6,244,381 | B1 | | 6/2001 | Ruble | |
| 6,533,070 | B1 | * | 3/2003 | Elrod | 182/103 |
| 8,002,512 | B1 | | 8/2011 | Blehm | |
| 2005/0139425 | A1 | | 6/2005 | Thomas | |
| 2005/0268434 | A1 | * | 12/2005 | Burbrink et al. | 16/324 |
| 2011/0168492 | A1 | * | 7/2011 | Johnson | 182/107 |

OTHER PUBLICATIONS

Boeker, May-Jun. 2008 Toplift Price List, available at http://www.boeckeramericas.com/pdf/PL_Toplift%2008%20Price%20List%20USA%20-CTS%20-%20No%20Prices.pdf.*

(Continued)

*Primary Examiner* — Saul Rodriguez
*Assistant Examiner* — Mark Hageman
(74) *Attorney, Agent, or Firm* — Charles W. Hanor

(57) ABSTRACT

A lifting mechanism and method for lifting materials onto a structure having a first elongated section having a winch lifting mechanism and a second section slidably mounted on the first section for moving upward and downward and roller guide members for engaging the first and second sections to allow the sliding and a lockable support frame pivotally connected to the second section for securing materials on one side of the first section for lifting onto a structure and rotating to an upper unloading position on the other side of the first and second sections.

18 Claims, 12 Drawing Sheets

(56) References Cited

OTHER PUBLICATIONS

Boeker, Toplift Brocuhure, Jun. 2010, available at http://www.boecker-group.com/uploads/media/Toplift_Construction_Lift_GB_07_2010.pdf.*

CME35 4 cu ft cement mixer brochure dated Jan. 2012, available at http://www.homedepot.com/catalog/pdfImages/61/61197009-90c1-4bed-b72f-76114ccee362.pdf.*

* cited by examiner

MATERIAL LIFTING MECHANISM

CROSS-REFERENCE TO RELATED APPLICATIONS

None.

STATEMENTS REGARDING FEDERALLY SPONSORED RESEARCH OR DEVELOPMENT

None.

REFERENCE TO A MICROFICHE APPENDIX

None.

BACKGROUND OF THE INVENTION

1. Field of the Invention

The invention relates to material or panel lifting mechanisms for lifting and unloading material, and particularly large panels or sheets or flat materials, onto a structure such as a building roof.

2. Description of the Related Art

U.S. Pat. No. 4,179,011 issued to Janus Morawski discloses a ladder stabilizing bracing device for attaching to the upper end of a ladder to secure it to the roof of a building. The ladder stabilizing brace comprises a pair of metal arms that attach to the sides of the ladder and extend to a flat rectangular support platform designed to be in contact with a roof. The device disclosed in the '011 patent further discloses the use of a pair of support beams affixed to the ladder's sides and connected to the metal arms to further stabilize the ladder.

U.S. Pat. No. 4,183,423 issued to James P. Lewis discloses a motorized ladder hoist with an adjustable carrier platform that "pivots to horizontal position when the carriage reaches the top." The ladder hoist is winch operated and contains wheels at the bottom of the ladder to ease transportation to and from a work site. The carrier platform of the hoist travels on rollers along the channel tracks of the ladder. The carrier platform further makes use of stakes to help secure the loads in place during movement up or down the hoist.

U.S. Pat. No. 5,165,501 issued to Howard E. Donahey discloses an adjustable ladder stabilizing device that mounts to the sides of a ladder. The disclosed ladder stabilizer makes use of extension arms that connect to a support platform that transfer weight from the ladder onto a structure. The '501 patent discloses the use of numerous support beams to add rigidity to the ladder stabilizer device.

U.S. Pat. No. 5,180,032 issued to Martiniano Hidalgo discloses a device for securing and stabilizing a ladder to a rooftop or vertical wall. The stabilizing device attaches to the tracks of a ladder and extends a pair of adjustable arms that connect to support anchor platforms designed to engage the roof or vertical wall of a structure.

U.S. Pat. No. 5,743,356 issued to Frank A. Mitchell discloses a ladder stabilizing device that attaches to the tracks and rungs of a ladder to secure the ladder to the rooftop of a building while also protecting the edge and/or gutters of the roof from damage that could be caused by the ladder. The stabilizing device disclosed in the '356 patent teaches extending a ladder away from the roof through the use of a pair of extension arms that connect to a pair of adjustable support arms that attach to a flat support platform designed to be in contact with a roof.

U.S. Pat. No. 5,855,252 issued to Jan William Vrolyks discloses a ladder stabilizing device that attaches to the top end of a ladder. The ladder stabilizing device of the '252 patent mounts to the rungs of a ladder and extends a ladder away from a wall.

U.S. Pat. No. 5,911,287 issued to Ronald L. Campbell discloses a manually operated ladder hoist with a sled that lifts loads up the ladder and a ladder stabilizing attachment. The ladder stabilizing attachment of the '287 patent comprises a brace member that fastens to the rails of a ladder and two rotating arms that extend from the brace member to flat support surfaces designed to be in contact with a rooftop.

U.S. Pat. No. 6,244,381 issued to Timothy E. Ruble discloses a ladder hoist and the use of attaching roller guides to an extension ladder allowing the lifting platform to transition smoothly from one section of the extension ladder to the next section. The '381 patent further teaches the use of a power tool gear and pulley system to lift the carrier platform up the ladder hoist. This publication does not disclose the use of ladder stabilizers or carrier platforms specially designed to securely hold flat rectangular loads.

U.S. Pat. No. 8,002,512 issued to Berle G. Blehm discloses a ladder hoist with an adjustable lift tray. The lifting carrier tray is adjustable to accommodate different desired angles of the tray in relation to the ladder and/or roof pitch. The carrier tray is made up of horizontal and vertical support beams designed to carry flat panel loads.

U.S. Pre-Grant Publication 2005/0139425 by Merle Thomas et al. discloses a ladder stabilizer device that mounts onto the top rungs of a ladder and transfers weight from the ladder onto the horizontal or pitched surface of a roof. The '425 publication discloses the use of adjustable angle extension arms and support beams that connect to a flat support plate designed to be in contact with a roof surface.

BRIEF SUMMARY OF THE INVENTION

A lifting mechanism is provided for lifting and unloading materials onto a structure. The lifting mechanism has a first elongated section having a winch lifting mechanism and a second section slidably mounted on the first section for moving upward and downward with the winch lifting mechanism. Roller guide members engage the first and second sections to facilitate the sliding, particularly when loaded. A support frame is pivotally connected to the second section for securing materials on one side of the first section for lifting onto a structure and so that the support frame can be loaded with materials on one side of the first and second sections and raised and can be rotated on the second section to an upper unloading position on the other side of the first and second sections. A releasable lock for securing the support frame in a lower and loading position on one side of the first section for lifting materials with the lifting mechanism to a upper and unloading position on the other side of the first and second sections to position materials for removing and unloading materials onto a structure. The support frame includes a material support that is rotatably mounted to the support frame and movable to support an upper edge of materials at an upwardly inclined angle toward the first and second sections.

The support frame includes a material support that is rotatably mounted to the support frame and movable to support an upper edge of material at a downwardly inclined angle away from the first and second sections and movable to support an upper edge of materials at an upwardly inclined angle toward the first and second sections.

The support frame includes a material support that is rotatably mounted to the support frame and movable to support an upper edge of materials at an acute angle toward the first and second sections and movable to support the upper edge of material at acute angle away from the first and second sections.

The releasable lock that holds the material support in a selected position and allows rotation of the material support to another selected position. A control arm is mounted on the material support to rotate it from the raising position to the unloading position on the support frame and a control lever can be actuated to engage and release the lock. The releasable lock has ratchet teeth for holding the material support in a selected position.

Adjustment slots are provided for the roller guide members to adjust rollers on the roller guide members. The roller guide members are connected between upper and lower ends of the second section and the first section and include at least two rollers that engage the first section.

A plurality of releasable material clamps on the support frame for securing materials on the support frame and adjustment pins to allow the positioning of different sized materials on the support frame. The support frame has extendable members to allow the positioning of different sized materials on the support frame.

A structure mount is connected to the lower section for supporting the lower section on a structure and has structure support pads connected to the lower section for supporting the lower section on a structure and ball joints connecting the structure support pads to the structure mount.

The method for lifting materials onto a structure comprising the steps of positioning materials on a support frame on one side of the first and second sections of a lifting mechanism and slidably raising the second section on the first section for moving the support frame upward with a winch lifting mechanism and releasing a lock for pivoting the materials to the other side of the first and second sections to an upper unloading position on the other side of the first and second sections to position materials for removing and unloading materials onto a structure.

DETAILED DESCRIPTION OF THE INVENTION

Figure 1:
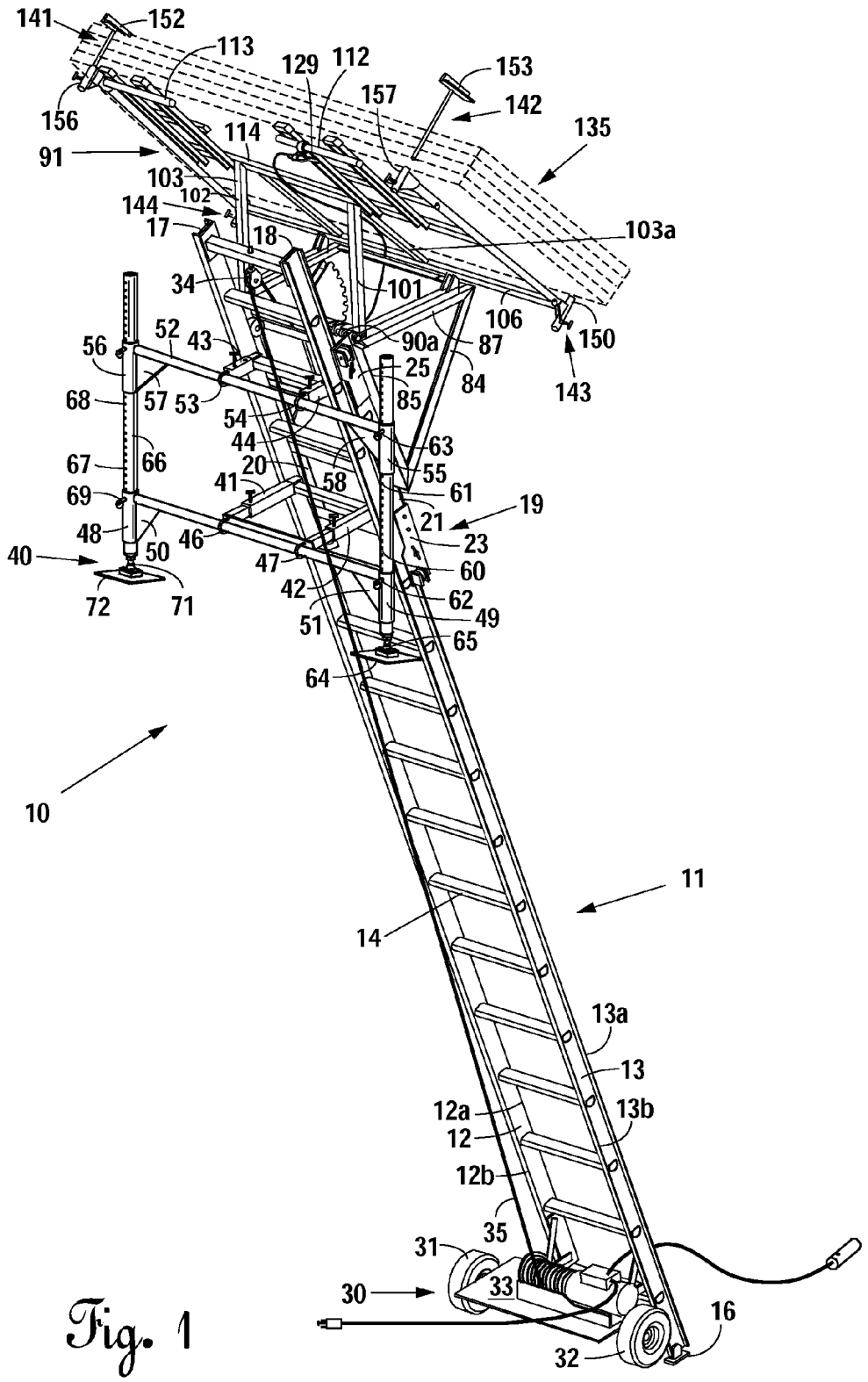
FIG. 1 is an isometric drawing of the invention showing a ladder lifting mechanism.
Figure 3:
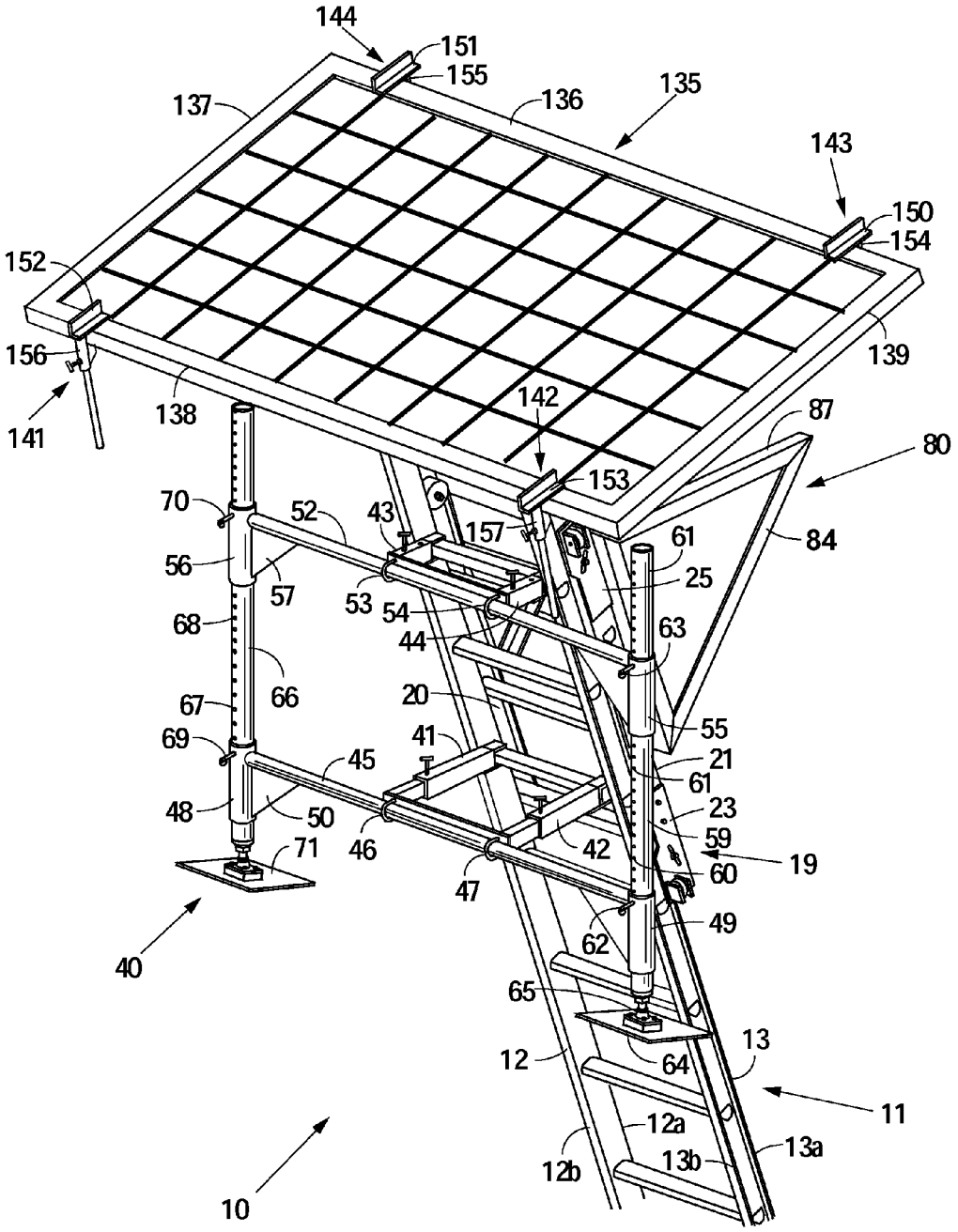
FIG. 3 is an isometric drawing of the left rear side of the invention with a solar panel positioned on the lifting mechanism.

A preferred embodiment of the invention is shown in FIG. 1. The lifting mechanism 10 includes a lower section 11 having right and left parallel side rails 12 and 13 and a plurality of perpendicular cross members 14 secured to each side of the side rails 12 and 13. The cross members or steps 14 act as spacers between the side rails 12 and 13 and are connected via convention mechanism such as welding. The side rails 12 and 13 have an I-beam construction with upper and lower I-beam members 12*a* and 12*b* and 13*a* and 13*b* which contributes to their strength. The identical left skid member (not shown) and right skid member 16 are pivotally secured to the lower end portions of the side rails 12 and 13. Upper end portions 17 and 18, shown in FIG. 3, are located at the upper ends of the side rails 12 and 13. This may take the form of a ladder section that is inexpensive and strong. Only one lower section is shown. Additional sections could be attached to the upper end of lower section 11 to extend it for higher structures.

A second section 19 shown in FIG. 1 and enlarged FIG. 2 and FIGS. 3-5 is slidably attached to the lower section 11. The second section 19 has parallel side rails 20 and 21. A plurality of perpendicular cross members 22*a* is secured to each side of the rails 20 and 21. The side rails 20 and 21 have an I-beam construction with upper and lower I-beam members 20*a* and 20*b* and 21*a* and 21*b* which contributes to their strength. Although only first and second sections 11 and 19 are shown, additional sections may be used so that they telescope out and increase the height to which the second section 19 extends.

Figure 9:
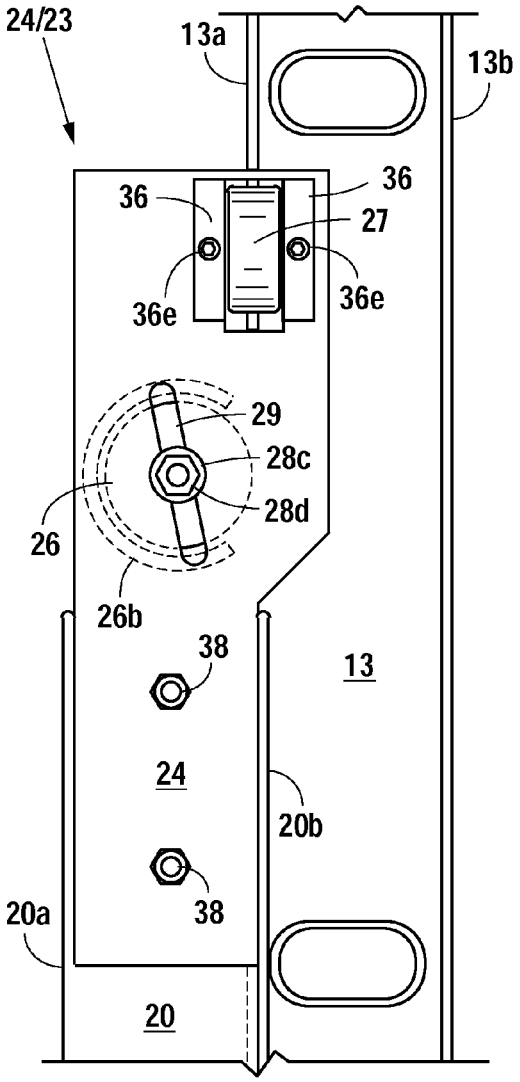
FIG. 9 is a front view of a roller guide member.
Figure 10:
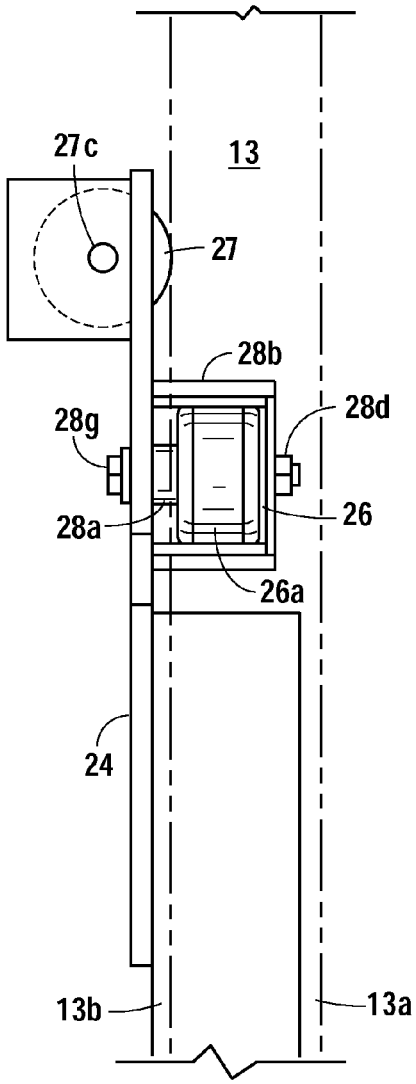
FIG. 10 is a profile view of a roller guide member.

The upper surfaces of the lower I-beam members 20*b* and 21*b* are positioned below the lower surfaces of the upper I-beam members 12*a* and 13*a* to allow the second section 19 to slide along the lower section 13 and retain the second section 19 onto the lower section 11 like a conventional extension ladder. Because of the large loads that may be placed on the lifting mechanism 10, four roller guide members 22, 23, 24 and 25, shown in FIGS. 2, 3, 8, 9 and 10 are positioned at the lower and upper ends of the side rails 20 and 21 to allow the second section 19 to slide along the lower section 11 without catching or binding under load. As shown in FIGS. 9-10 each guide member has a roller 26 that engages the upper surfaces of the I-beam members 12*a* and 13*a* and a roller 27 that engages the outside side surfaces of the I-beam members 12*a* and 13*a* to reduce friction and maintain the second section in position as it slides upwardly along the lower section 10 so that it does not bind. The rollers 26 and 27 are mounted on pins 27*a* and 28 that are secured to the roller guide members 22, 23, 24 and 25. The rollers 26 include roller surfaces 26*a* which engage and mate with the top surface of the beams 12*a* and 13*a*. The rollers 27 also include roller surfaces 27*c* which engage and mate with the outer edges of the beams 12*a* and 13*a*. The pin or axle 28 has an enlarged head 28*g* and a threaded end 28*f* and serves to rotatably support the upper roller 26 is mounted in an inclined slot 29 in the upper side rails so that the rollers can be adjusted and can easily slide with no load. A bushing 28*a* slides onto the pin or axle 28 to space the roller 26 from the bracket 24. The roller 26 includes a cylindrical aperture 26*b* for receiving the pin 28. A housing 28*b* mounts over the roller 26 and has an aperture 28*e* for receiving the pin 28. A lock washer 28*c* and nut 28*d* are secured to the threaded end 28*f* of the pin 28. The slots 29 allow adjustment of the rollers 26 to inhibit binding of the rails during lifting under load. When the second section is carrying a load the pivot pin 28 has been adjusted in the slot 29 to carry the load and allow easy movement of the second section 19 relative to the lower section 11.

The roller 27 is mounted to the bracket 24 with supports 36 and pin or axle 27*c* with bolts 37*a* that extend through apertures 37*b* and screw into threaded apertures 36*c*. The pin or axle 27*c* is mounted in apertures 36*d* in the supports 36. Set screws 36*e* screw into threaded apertures in the supports 36 and engage the ends of the pin or axle 27*c* to hold it in place. The axle 27*c* could be secured to the roller 27 or to the supports 36. Bolts 38 secure the brackets to the rails. Rectangular slots 39 in the brackets receive the rollers 27 which extend through the slots so the roller surfaces 27*a* engage the rails.

Figure 4:
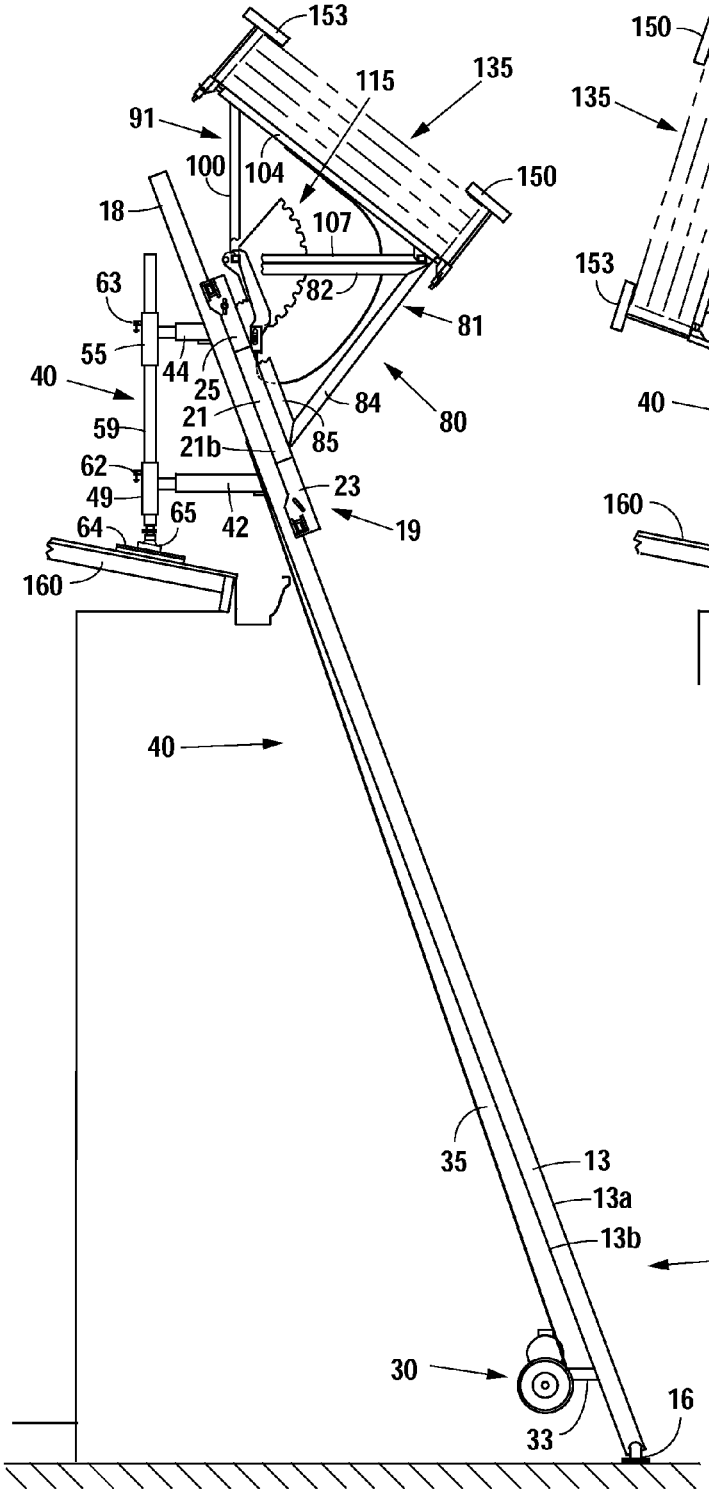
FIG. 4 is a profile drawing of the left side of the invention with solar panels positioned on the lifting mechanism, where the lifting mechanism is attached to a ladder and mounted on a roof.

A conventional electric winch 30 as shown in FIG. 4 is secured to the lower portion of the lower section 11 for raising and lowering the second section 19. The winch 30 has a reversible electric motor and an internal break to lock the cable and second section 19 in position when power is turned off. Wheels 31 and 32 shown in in FIG. 1 are mounted to the frame 33, FIG. 4, of the electric winch 30 to allow transport of the lifting mechanism 10 when it is moved to a substantially horizontal position. In the raised position shown in the drawings, the wheels 31 and 32 are positioned to not facilitate rolling so that the identical pivotally mounted right skid member (not shown) and pivotally mounted left skid member 16 firmly engage the ground to reduce movement of the lifting mechanism away from a structure. The winch has a wire cable 35, FIG. 4, which extends over the pulley 34 as shown in FIG. 4 and is attached to the second section 19 to raise and lower it.

Figure 13:
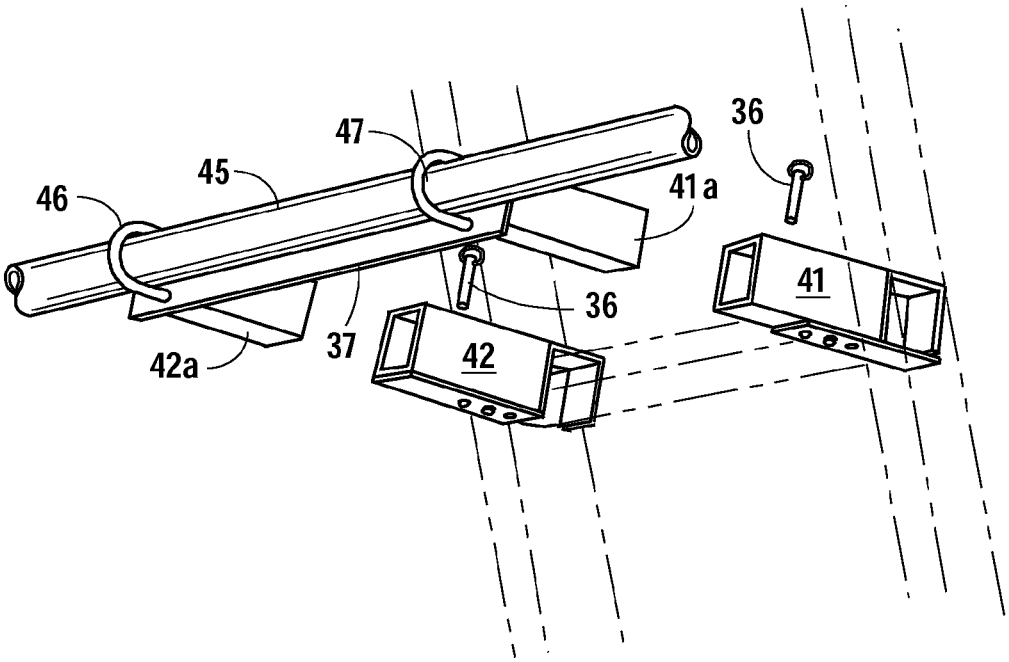
FIG. 13 is an isometric view of the clamping system of the structure mount.
Figure 14:
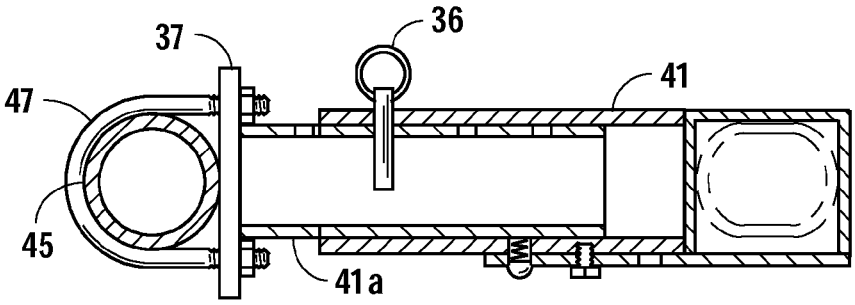
FIG. 14 is a side view of the clamping system of the structure mount.

A structure or building upper support 40, shown in FIGS. 1-5, at the upper end of section 11 allows the lifting mechanism to be positioned adjacent a structure. The structure support 40 includes horizontal telescoping and adjustable beams 41, 42, 43 and 44 and 41*a* and 42*a* that are secured at one end to outer edges of the cross members 14 adjacent the side rails 12 and 13 and extend therefrom. The ends of the telescoping beams 41*a* and 42*a* are secured to round horizontal beam 45 by suitable securing mechanism such as clamps 46 and 47. Round sections of tubing 48 and 49 along with braces 50 and 51 are secured to the outer ends of beam 45. The other end of the beams 43 and 44 are secured to round horizontal beam 52 by suitable securing mechanism such as clamps 53 and 54. Round sections of tubing 55 and 56 along with braces 57 and 58 are secured to the outer ends of beam 52. The details of the telescoping beams 41, 42, 43 and 44 are shown in FIGS. 13-14.

A round section of tubing 59, FIG. 3, has a series of lower apertures 60 and upper apertures 61 slidably extend through tubing sections 49 and 55. Removable lock pins 62 and 63 extend though apertures in the tubing sections 49 and 55 and through selected apertures 60 and 61 to allow vertical adjustability of the tubing 59. This allows the lifting mechanism to be used on roof 160, FIG. 4, of varying slope. A support pad 64 is pivotally connected by ball 65 to the lower end of tubing 60 and may be positioned to rest on a roof 160 or other structure. Another round section of tubing 66 has a series of lower apertures 67 and upper apertures 68 slidably extend through tubing sections 48 and 56. Removable lock pins 69 and 70 extend though apertures in the tubing sections 48 and 56 and through selected apertures 67 and 68 to allow adjustability of the tubing 66. A support pad 71 is pivotally connected by ball joint 72, FIGS. 6-7, to the lower end of tubing 66 and may be positioned to rest on a roof 160 or other structure.

Figure 5:
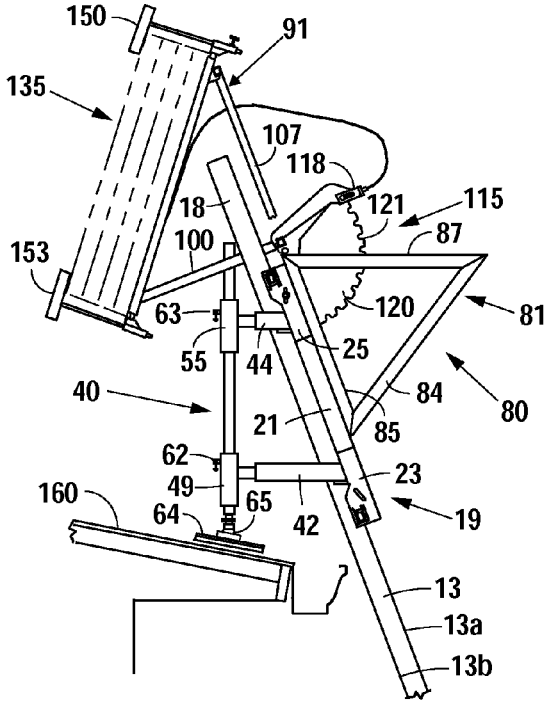
FIG. 5 is a profile drawing of the upper left side of the invention with solar panels positioned on the invention and showing the lifting mechanism in the lowered position, where the invention is mounted on a roof
Figure 6:
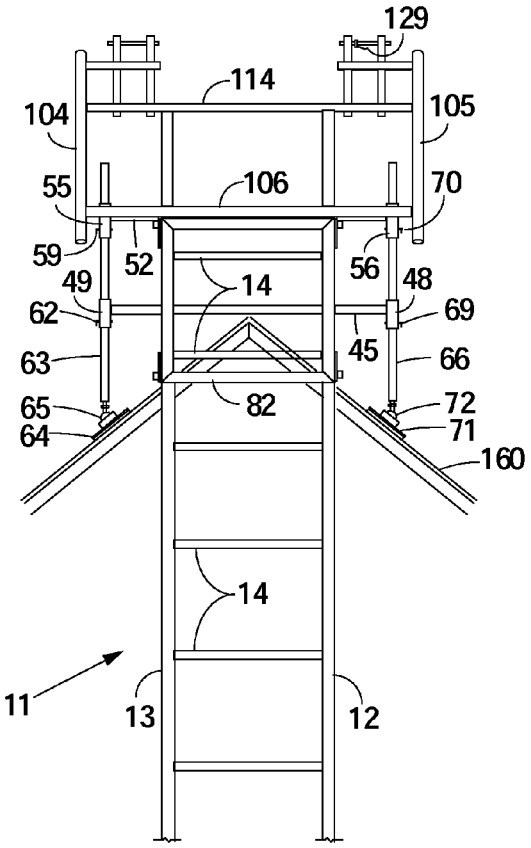
FIG. 6 is a front view of the invention shown mounted on a roof with an even pitch on each side.
Figure 7:
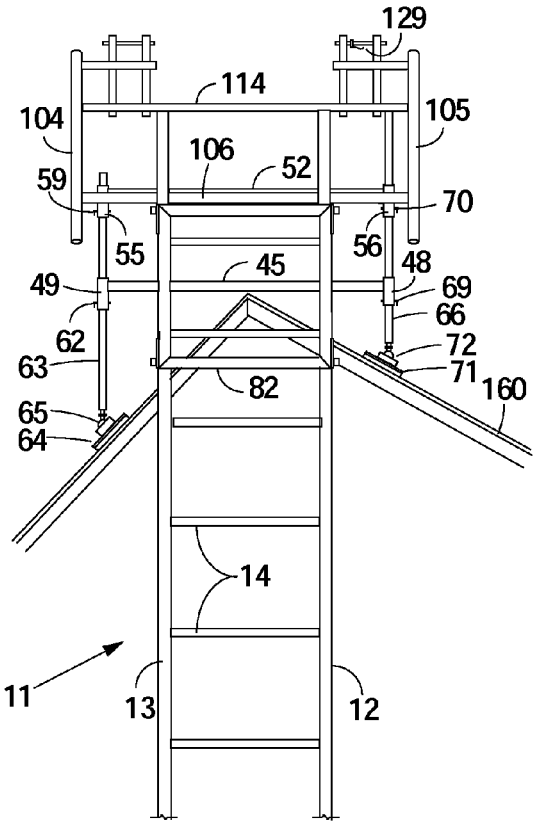
FIG. 7 is a front view of the invention shown mounted on a roof with an uneven pitch on each side in order to show the flexibility of the mounting system.
Figure 8:
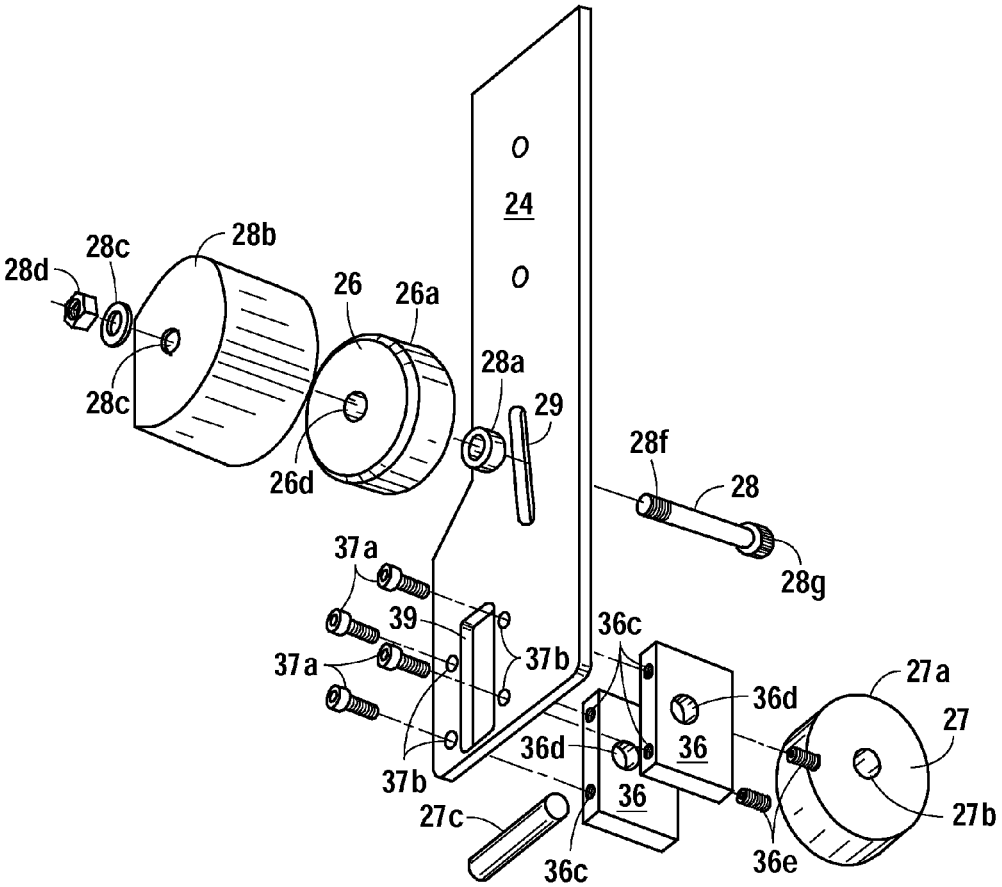
FIG. 8 is an exploded drawing of a roller guide member.
Figure 12:
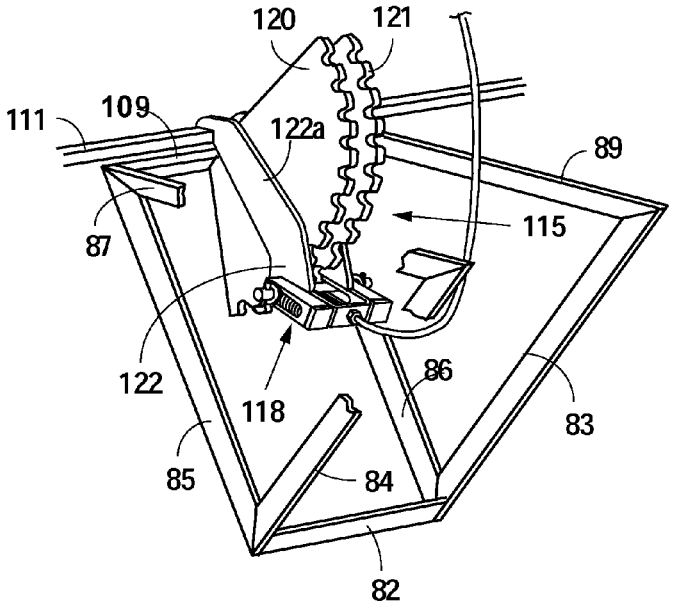
FIG. 12 is an isometric isolated view of the invention.

A triangular shaped material support frame 80 is mounted to the second section 19. The material support frame has a fixed lower section 81 secured to the second section 19 and a pivotally or rotatably mounted material support 91. The lower section 80 as shown in FIGS. 5 and 6 comprises bars 82, 83, 84, 85, 86, 87 and 88 (see FIG. 12) that are connected together by suitable mechanism such as welding to form a triangular lower support. The pivotally mounted material support 91 is triangular in shape and is connected at an apex to the second section 19 via pivot pins 90 and pivot hinges 90*a* and 90*b* as shown in FIG. 4 at the upper end of 11 the second section. The support frame 80 includes a frame section 91 that is triangular from the side and comprises elongated members 102, 103, 103*a*, 104, 105, 106, 107, 108, 109, 110,111, 113 and 114 that are connected together by suitable mechanism such as welding. Members 112*a* and cross member 112 shown in FIG. 2 support the release latch 129.

Figure 15:
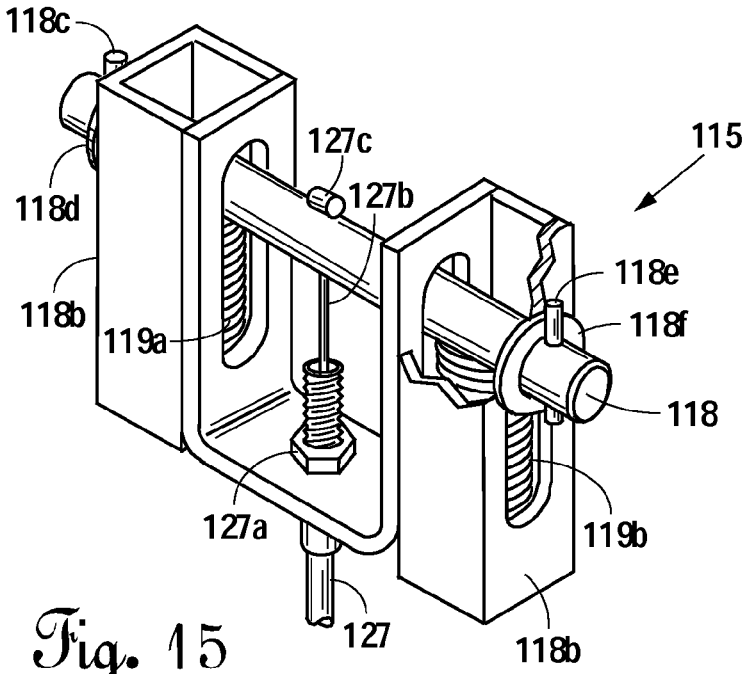
FIG. 15 is a partial view of the ratchet release.
Figure 16:
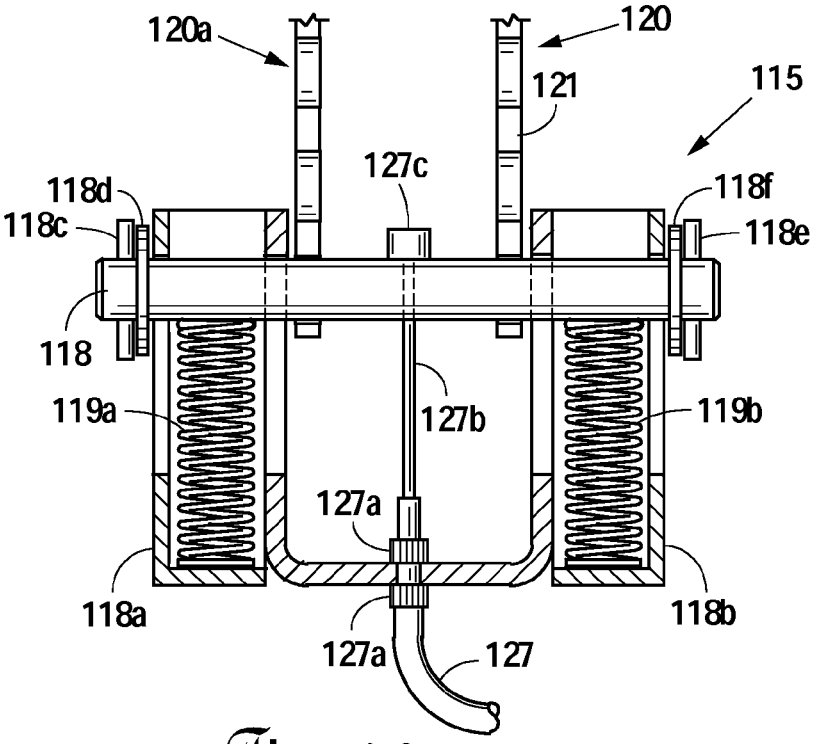
FIG. 16 is a cross sectional view of the ratchet release.
Figure 18:
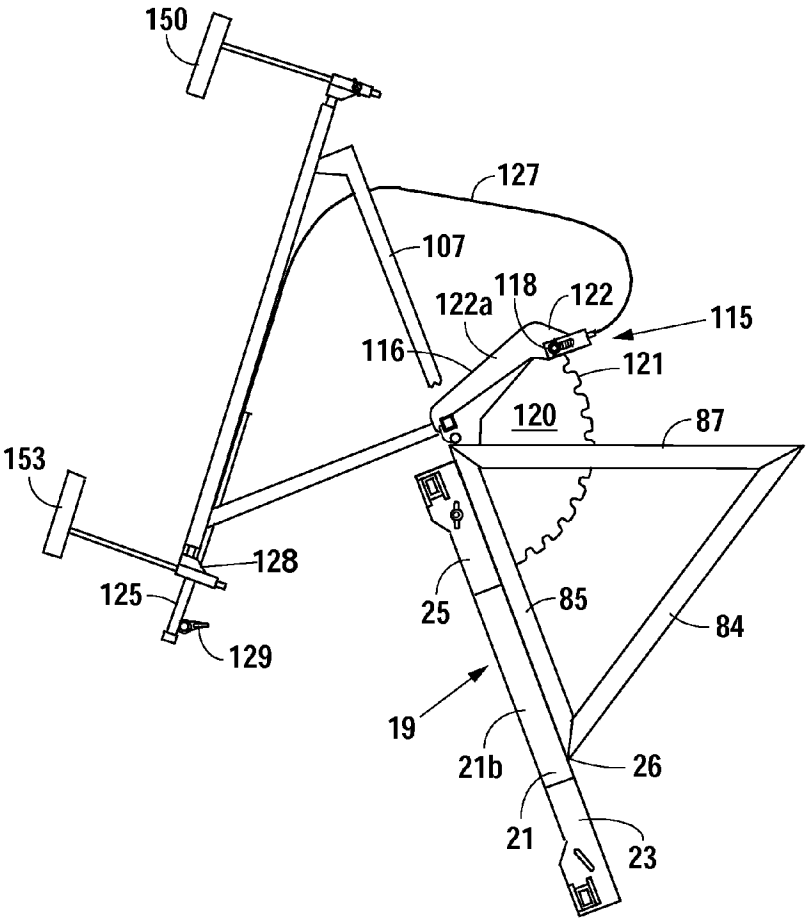
FIG. 18 is a partial side view of the vehicle shown in the lowered or unloading position with the pivotally or rotatably mounted material support having lifted the material support frame.
Figure 17:
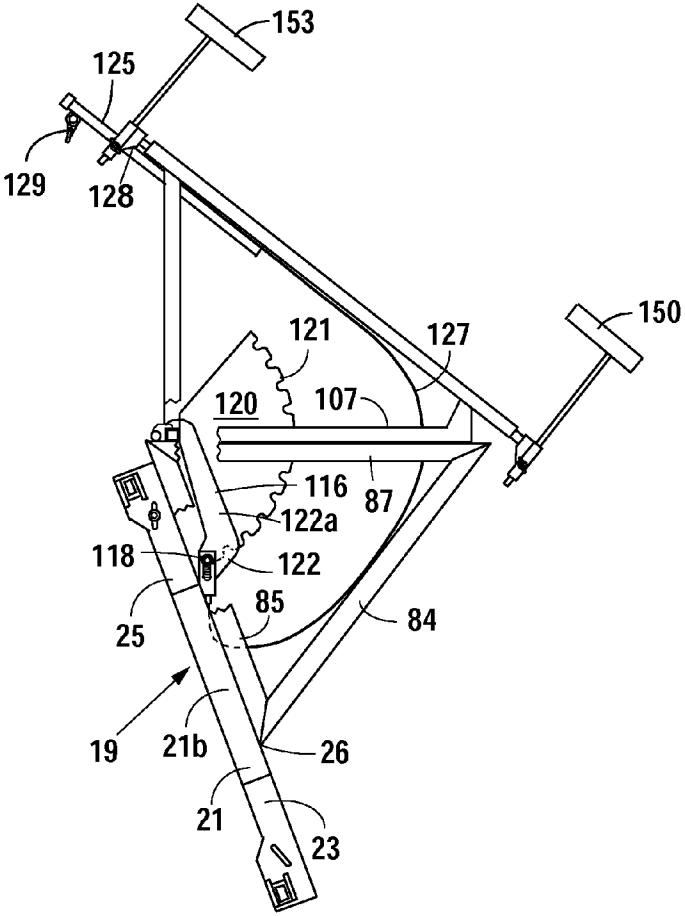
FIG. 17 is a side partial view of the invention shown in the lifting position with the pivotally mounted material support resting on the material support frame.
Figure 19:
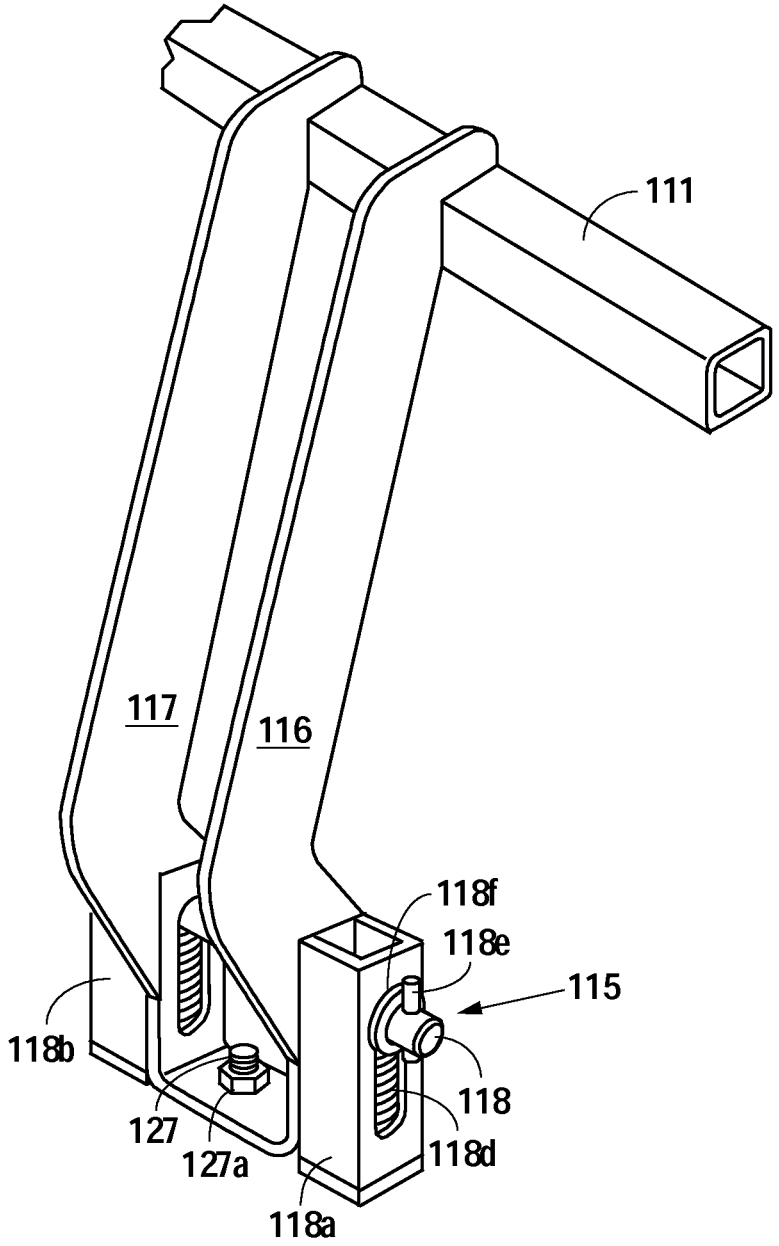
FIG. 19 is a partial view of the releasable locking mechanism to control rotation and orientation of the material support frame.

An upper support lock and rotating mechanism 115 is shown in FIGS. 15-19. It comprises bars 116, and 117 as shown in FIG. 19. A locking pin 118, FIGS. 15-16 and 19 is spring biased with springs 119*a* and 119*b* outward into engagement with the ratchet teeth 121. The locking pin 118 is held in place by pins 118*c* and 118*e* and washers 118*d* and 118*f*. The housings 118*a* and 118*b* contain the springs 119*a* and 119*b*. The control members 120 and 120*a* are secured to the fixed lower section 81 and includes a plurality of ratchet teeth 121. The locking pin 118 is connected to a sheathed cable 127 with cable 127*b* which moves the locking pin 118 into and out of engagement with the ratchet teeth 121 to lock the upper from rotation with the ratchet teeth 121 to hold the pivotally mounted material support 91 at a desired angle. The cable 127*b* extends through an aperture in the pin 118 and has a stop 127*c* engaging the pin 118. Adjustable locking nuts 127*a* allows for adjustment of the cable relative to the locking pin 118. The section 91 can be rotated as shown in FIGS. 17-18 for loading and lifting and lowering, FIG. 17 and for unloading, FIG. 18.

An elongated control arm 125, shown in FIGS. 17 and 18 is connected to the bars 106 and 114 and extends above the pivotally mounted material support 91. The control arm acts as a handle to rotate the frame section 91 from its resting loading position shown in FIG. 17 to the unloading position show in FIG. 18. A sheathed control cable 127 is connected is connected to the pin 118 and extends upwardly to the bracket 128 at the upper end of the control arm 125. A pivoting control lever 129 is connected to the cable 127*b* and moves the pin 118 from an engaged position in one of the ratchet teeth 121 to a disengaged position to allow rotating of the frame section 91 and locking it in a desired position.

As shown in FIG. 3, one example of material that can be lifted into position is a large flat panel or sheet 135 having edges 136, 137, 138 and 139, is secured to the frame section 91 and can be raised from the ground to the top of the section 11. Multiple panels or sheets of material may be lifted at one time. The panels or sheets may be standard solar panels that are about 39 inches wide and 65 long for some solar panels and may weigh around 43 pounds. Because of the large size of the panels they can be difficult to safely carry up a ladder to the top of a structure for installation. Also once they are lifted to the point of installation such as a roof of a structure, they need to be positioned so they can be unloaded onto the structure.

The frame section 91 is positioned in the down position with the pin 118 engaging the lower most of the ratchet teeth 121. Although only one panel is shown on the lifting mechanism in FIG. 3, several more panels may be loaded at each time to quickly lift multiple panels onto a structure as shown in FIGS. 4-5. After the frame section 91 is raised to the top of a structure, an operator standing on the structure can grab hold of the control arm 125 and pull the control lever 129 to disengage the pin 118. This allows the operator to rotate panels to the position shown in FIGS. 5 and 18 to reengage the pin 118 with the upper most of the ratchet teeth 121 to again lock the panel in place. Then the panel 135 can be removed from the lifting mechanism for use on the structure.

The geometry of the frame section 91 and location of the pivot pins 90 in hinges 90*a* and 90*b* are such that when one or more panels 135 are in the raised position shown in FIG. 4, it is easier for an operator to rotate the upper section to the unloading position shown in FIG. 5. In the fully raised position, the panels 135 are above the ends 17 and 18 of the lower section 11 to make it easier for the operator move and hold the pivotally mounted material support. This is facilitated by the material being positioned and located on the frame section so it may be moved by one person when unlocked and rotated to the unloading position. This also positions the panel so it can be easily lifted off the frame section 91.

Figure 2:
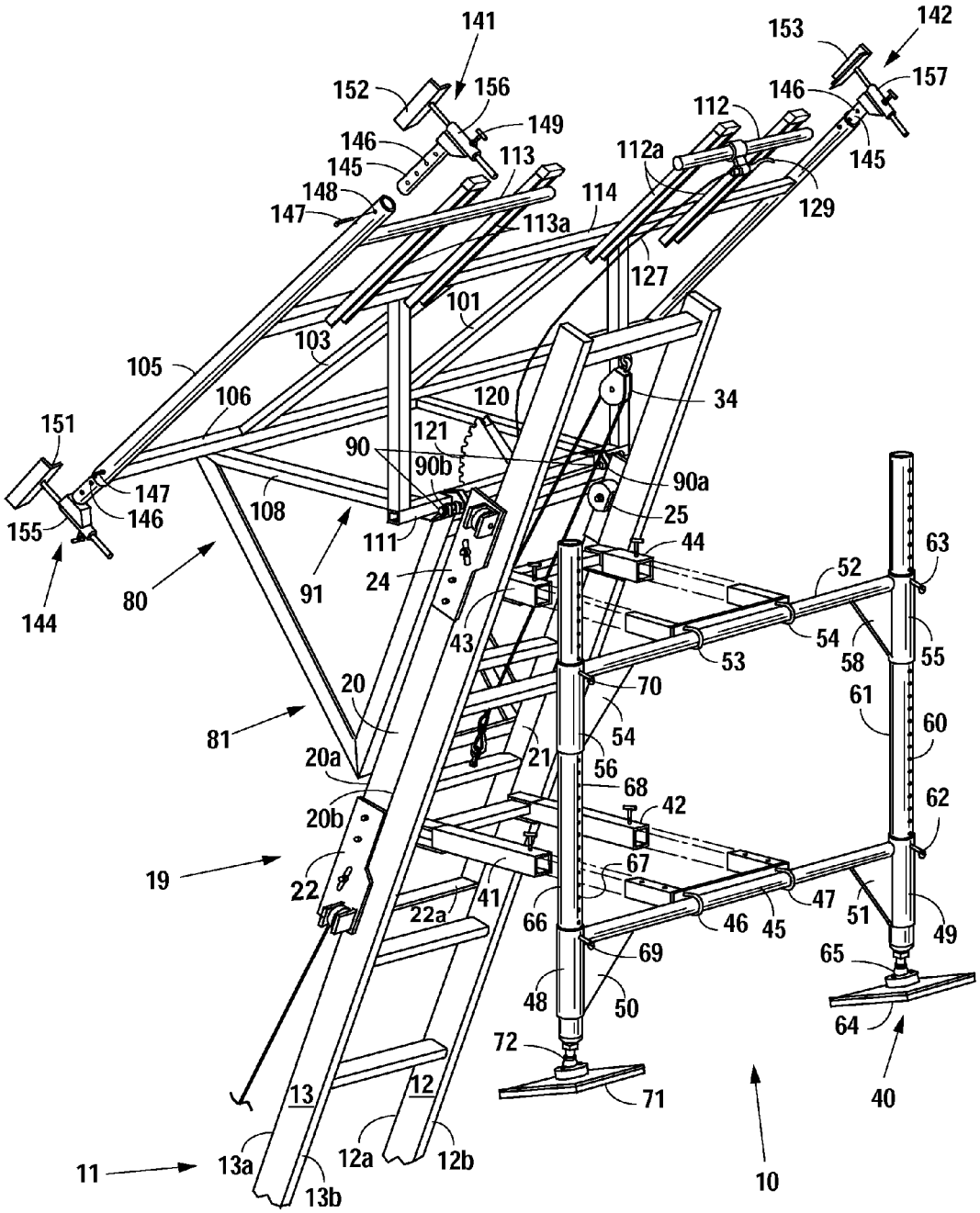
FIG. 2 is an isometric drawing of the right rear side of the invention.

As shown in FIG. 3, the panels are held in position by releasable panel or material clamps 141, 142, 143 and 144 that are mounted on telescoping tubular members 145 that are slidably and adjustably mounted in the tubular members 104 and 105 as shown in FIG. 2. The tubular members 145 include a plurality of apertures 146 that mate with an aperture 148 and are held in place by removable lock pin 147. The plurality of apertures 146 allows securing panels of different sizes on the lifting mechanism. The material clamps include retaining tabs 150, 151, 152 and 153 that are secured to members 154, 155, 156, and 157 respectively. The lower surface of the retaining tabs 150, 151, 152 and 153 engage the upper surface of the panel 135 to hold it in place on the lifting mechanism. The panels 135 are shown with the clamps engaged in FIGS. 1 and 4-5.

The material support that can be rotated to position an upper edge of materials at an acute angle toward the first and second sections and is movable to position the upper edge of material at acute angle away from the first and second sections as shown in FIGS. 4 and 5. The material support is shown in FIG. 4 supporting an upper edge of materials at an upwardly inclined angle toward the first and second sections and is shown in FIG. 5 with the upper edge of material at a downwardly inclined angle away from the first and second sections.

When the panel 135 is raised and tilted up as shown in FIGS. 4-5, the tabs 150 and 151 can be rotated until they no longer engage the panels. This allows release of the panels from the lifting mechanism so in can be installed on a structure. After the panels 135 are removed, the frame section 91 is rotated downward by pulling the control lever 129 to disengage the pin 118 from the upper tooth 121. The frame section 91 is locked into place in its lowered position so that the section 19 can be lowered to the ground and another panel put on the lifting mechanism for raising and installing on a structure.

Figure 11:
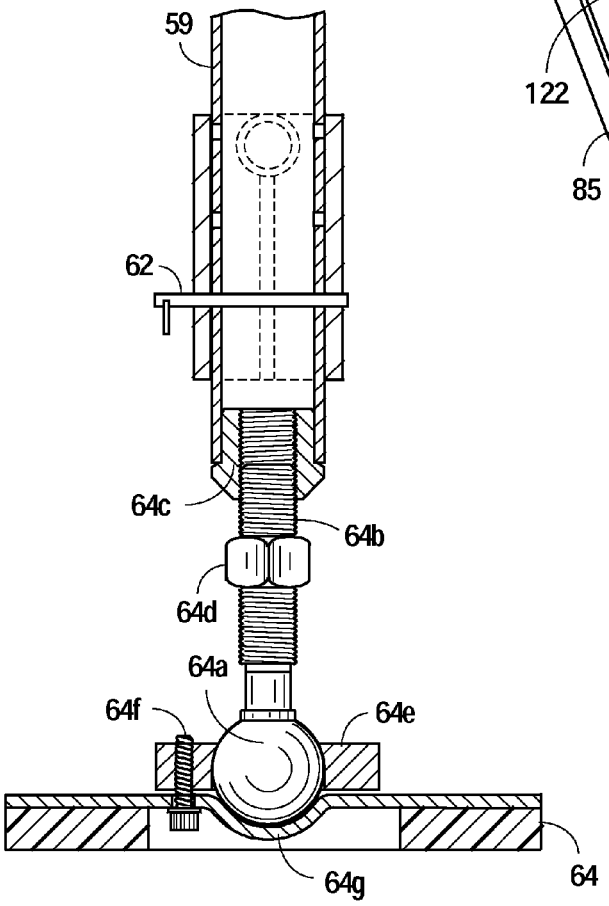
FIG. 11 is a ball joint for the roof support legs.

The ball joints 65 and 72 are shown in FIG. 11. A ball 64*a* is secured to the adjustable threaded rod 64*b* that is screwed into the threaded receptacle 64*c*. Lock nut 64*d* holds the rod in place. The ball 64*a* is pivotally mounted in the holder portion 64*g* and held in place by the top holder member 64*e* and the bolt 64*f*.

FIGS. 12-19 show the details of the releasable lock that allow rotation of the panel holder from the loading and raising position to the rotated unloading position when panels are raised to the top of the device for unloading on a roof.

In operation you position materials on a support frame on one side of the first and second sections of the lifting mechanism as shown in FIG. 4 for lifting the material onto a structure. You then operate the winch lifting mechanism to slidably raise the second section on the first section for moving the support frame upward. You then release the lock for pivoting the materials to the other side of the first and second sections to the upper unloading position on the other side of the first and second sections as shown in FIG. 5 to position materials for removing and unloading materials onto a structure.

The above-listed sections and included information are not exhaustive and are only exemplary or the invention. The particular sections and included information in a particular embodiment may depend upon the particular implementation and the included devices and resources. Although a system and method according to the present invention have been described in connection with the preferred embodiments, it is not intended to be limited to the specific form set forth herein, but, on the contrary, it is intended to cover such alternatives, modifications, and equivalents, as can be reasonably included within the spirit and scope of the invention as defined by the appended claims.

I claim:

1. A lifting mechanism for lifting materials onto a structure comprising:

a first elongated section having two sides and a winch lifting mechanism;

a second section slidably mounted on one side of the first section for moving upward and downward with the winch lifting mechanism;

roller guide members for engaging the first and second sections to allow the sliding of the second section on the said one side of the first section;

a support frame mounted on the second section and having a material support that is pivotally connected to the support frame on the second section for securing materials on the said one side of the first section for lifting onto a structure;

said material support being pivotally mounted on the said support frame on the second section so that the material support can be loaded with materials on said one side of the first and second sections and raised and can be rotated on the second section to an upper unloading position on the said other side of the first and second sections;

a releasable lock for pivotally securing the material support on the support frame in a plurality of locked positions including in a lower secured loading position for lifting the material support to a raised position to the top of the first section on said one side of the first section for lifting materials with the lifting mechanism to the upper and raised position and then for releasing the said material support for pivoting the material support to a selected unloading position when in its raised to the upper position on the said other side of the first and second sections to position materials for removing and unloading materials onto a structure supporting the other side of the first section.

2. The lifting mechanism of claim 1, further comprising: the said support frame including a said material support that is pivotally mounted to the said support frame and movable to support an upper edge of materials at an upwardly inclined angle toward the said first and second sections.

3. The lifting mechanism of claim 1, further comprising: the said support frame including a said material support that is pivotally mounted to the support frame and movable to support an upper edge of material at a downwardly inclined angle away from the said first and second sections.

4. The lifting mechanism of claim 1, further comprising: the support frame including a said material support that is pivotally mounted to the support frame and movable to support an upper edge of materials at an upwardly inclined angle toward the first and second sections and movable to support the upper edge of material at a downwardly inclined angle away from the first and second sections.

5. The lifting mechanism of claim 1, further comprising: the support frame including a said material support that is pivotally mounted to the support frame and movable to support an upper edge of materials at an acute angle toward the first and second sections and movable to support the upper edge of material at acute angle away from the first and second sections.

6. The lifting mechanism of claim 1, further comprising: the releasable lock holds the said material support in a selected position and allows rotation of the said material support to another selected position.

7. The lifting mechanism of claim 1, further comprising: a control arm mounted on the said material support to rotate it from the raising position to the unloading position on the said support frame.

8. The lifting mechanism of claim 1, further comprising: a control lever to engage and release the releasable lock.

9. The lifting mechanism of claim 1, further comprising: the releasable lock having ratchet teeth for holding the said material support in a selected position.

10. The lifting mechanism of claim 1, further comprising: adjustment slots for the said roller guide members to adjust rollers on the roller guide members.

11. The lifting mechanism of claim 1, further comprising: the said roller guide members are connected between upper and lower ends of the second section and the first section.

12. The lifting mechanism of claim 1, further comprising: the said roller guide members each include at least two rollers that engage the first section.

13. The lifting mechanism of claim 1, further comprising: a plurality of releasable material clamps on the said support frame for securing materials on the said support frame.

14. The lifting mechanism of claim 1, further comprising: at least two releasable material clamps on the said support frame for securing upper and lower edges of materials on the said support frame.

15. The lifting mechanism of claim 1, further comprising: at-least two releasable material clamps on the material support for securing upper and lower edges of materials on the said support frame and adjustment pins to allow the positioning of different sized materials on the said material support frame.

16. The lifting mechanism of claim 1, further comprising: the said material support has extendable members to allow the positioning of different sized materials on the said material support.

17. The lifting mechanism of claim 1, further comprising: a structure mount is connected to the said first elongated section for supporting it on a structure.

18. The lifting mechanism of claim 1, further comprising: a structure mount having structure support pads connected to the said first elongated section for supporting it on a structure and ball joints connecting the structure support pads to the structure mount.

* * * * *